United States Patent [19]

Watanabe et al.

[11] Patent Number: 4,561,762

[45] Date of Patent: Dec. 31, 1985

[54] IMAGE FORMING APPARATUS

[75] Inventors: Junji Watanabe; Yoshiaki Nawata, both of Yokohama, Japan

[73] Assignee: Tokyo Shibaura Denki Kabushiki Kaisha, Tokyo, Japan

[21] Appl. No.: 560,113

[22] Filed: Dec. 12, 1983

[30] Foreign Application Priority Data

Dec. 14, 1982 [JP] Japan ..... 57-218838

[51] Int. Cl.[4] ..... G03G 15/00

[52] U.S. Cl. ..... 355/3 R; 355/15

[58] Field of Search ..... 355/3 R, 15, 8, 14 R, 355/3 DR

[56] References Cited

U.S. PATENT DOCUMENTS 4,174,172 11/1979 Lane ..... 355/15

4,411,514 10/1983 Komori et al. ..... 355/8 X

*Primary Examiner*—R. L. Moses

*Attorney, Agent, or Firm*—Cushman, Darby & Cushman

[57] ABSTRACT

Disclosed is a copying apparatus which comprises a rotatable photoconductive drum, a charger unit for charging the drum, an exposure unit for exposing the charged drum in accordance with a document pattern, a developer unit for developing a latent image obtained by the exposure as a toner image, a transfer unit for transferring the toner image to paper, and a cleaning unit for removing toner remaining on the photoconductive drum after the transfer. The cleaning unit brings its cleaning blade into contact with the drum to scrape off the toner from the drum. The photoconductive drum is rotated at a speed considerably lower than the rotating speed for a copying mode after completion of a copying cycle, and is stopped after the passage of a predetermined time. When the drum is stopped, the cleaning blade is separated from the drum.

4 Claims, 25 Drawing Figures

IMAGE FORMING APPARATUS

BACKGROUND OF THE INVENTION

The present invention relates to an image forming apparatus such as an electronic copying apparatus.

An electronic copying apparatus is constructed so that a copy of a document is produced in a copying cycle having processes for charging the surface of a photoconductive drum, exposing the charged surface to form an electrostatic latent image thereon, developing the latent image into a toner image, transferring the toner image to paper, and cleaning the photoconductive drum after the transfer. In the cleaning process, a cleaning blade is pressed against the photoconductive drum to scrape off toner remaining on the drum. Conventionally, the cleaning blade is adapted to be pressed against the photoconductive drum during a copying operation, and to be removed from the drum after the copying operation is ended. In other words, the cleaning blade is pressed against and removed from the photoconductive drum for each copying cycle. If this copying cycle is repeated many times, the toner will flow to the back of the cleaning blade, exerting a bad influence on the image formation at the time of developing.

SUMMARY OF THE INVENTION

The object of the present invention is to provide an image forming apparatus capable of reducing the frequency of shifting of a cleaning blade relative to a photoconductive member, thereby restraining the toner from flowing to the back of the cleaning blade and the occurrence of a pitting phenomenon.

According to the present invention, a cleaning member is pressed against a photoconductive member, and the photoconductive member is adapted to be moved at a first speed in a copying mode for a copying operation including processes of charging, exposure, developing, transfer and cleaning, and at a second speed lower than the first speed in a non-copying mode after the completion of the copying operation. After the lowspeed drive is executed for a predetermined time, the photoconductive member is stopped, and the cleaning member is removed from the photoconductive member.

DETAILED DESCRIPTION OF THE PREFERRED EMBODIMENT

Figure 1:
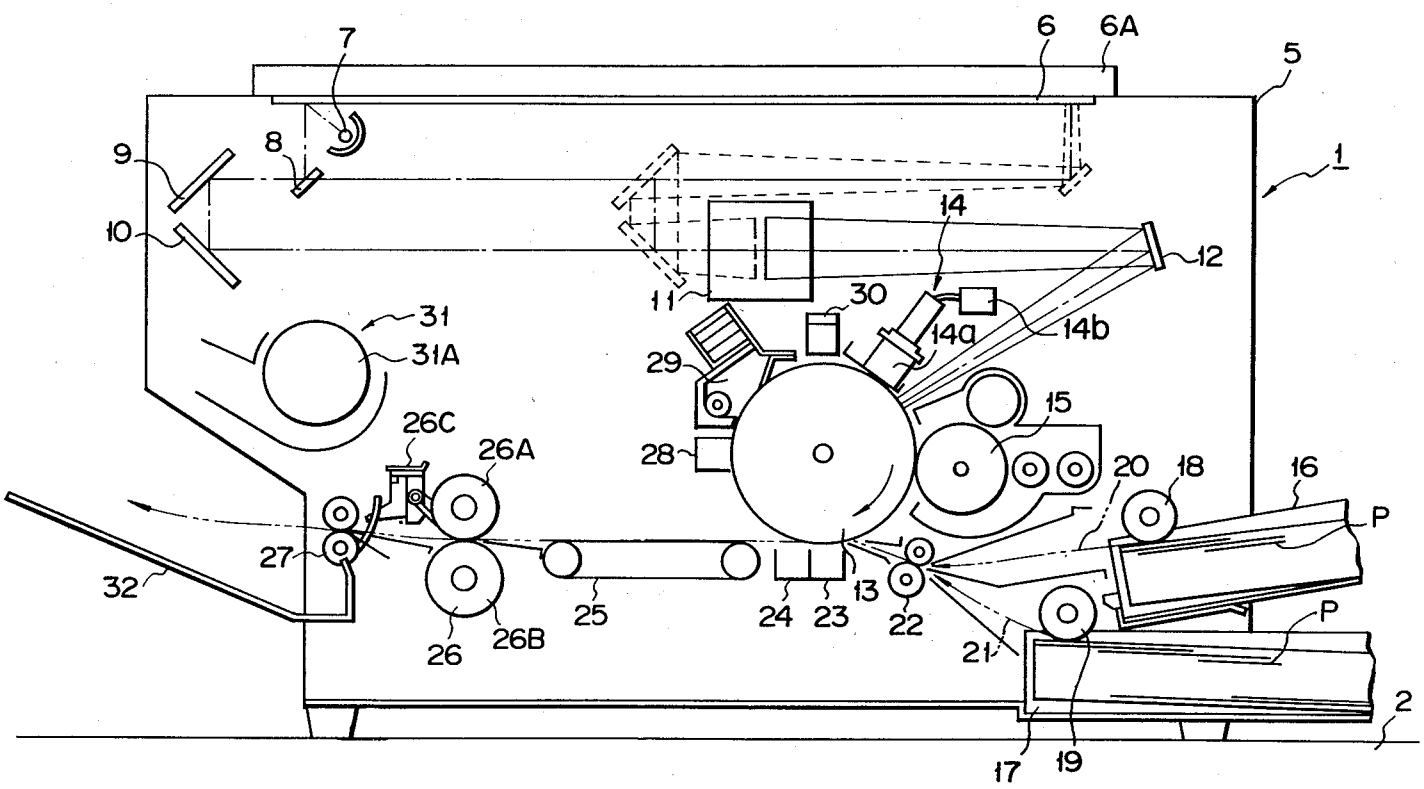
FIG. 1 shows an outline of an image forming apparatus, more specifically a copying apparatus, according to one embodiment of the present invention.
Figure 2:
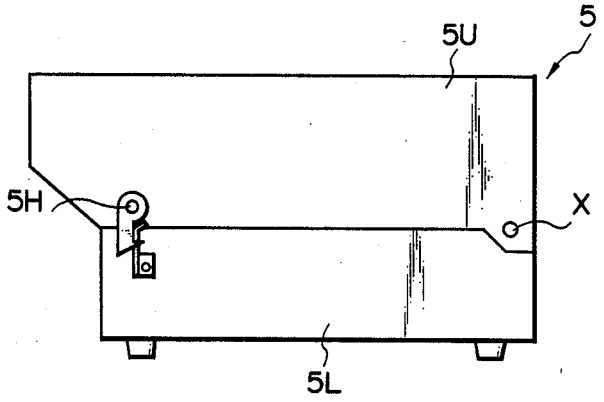
FIG. 2 is a side view of a cabinet of the copying apparatus of FIG. 1.

Referring now to FIGS. 1 and 2, an image forming apparatus, e.g., an electronic copying apparatus 1, is mounted on a table 2. A document table 6 formed of a transparent glass plate is put on the top of a cabinet 5, and a document cover 6A is swingably mounted on the document table 6. Under the document table 6 lies an exposure unit which includes an exposure lamp 7, mirrors 8, 9, 10 and 12, and a lens 11. A photoconductive drum 13 is disposed substantially on the center section of the cabinet 5 so as to be rotatable in the direction of the arrow. A charger unit 14, a developer unit 15, a transfer charger unit 23, a paper peeling charger unit 24, an erasing charger unit 28, a cleaning unit 29, and an erasing exposure unit 30 are successively arranged around the photoconductive drum 13 in the rotating direction thereof. Upper and lower paper cassettes 16 and 17 are removably attached to one side portion of the cabinet 5. Paper feeding rollers 18 and 19 are disposed in the cabinet 5 so as to be in contact with papers P stored in the paper cassettes 16 and 17. The paper P is delivered to a resist roller pair 22 through a guide 20 or 21.

A paper transporting belt 25 adjoins the paper peeling charger unit 24. A fusing roller pair 26 is arranged on the outlet side of the paper transporting belt 25. A paper discharging roller pair 27 is arranged on the paper discharge side of the fusing roller pair 26, whereby the paper is discharged into a tray 32. A cooling unit 31 including a cooling fan 31A serves to prevent a rise in temperature in the cabinet 5.

Figure 3:
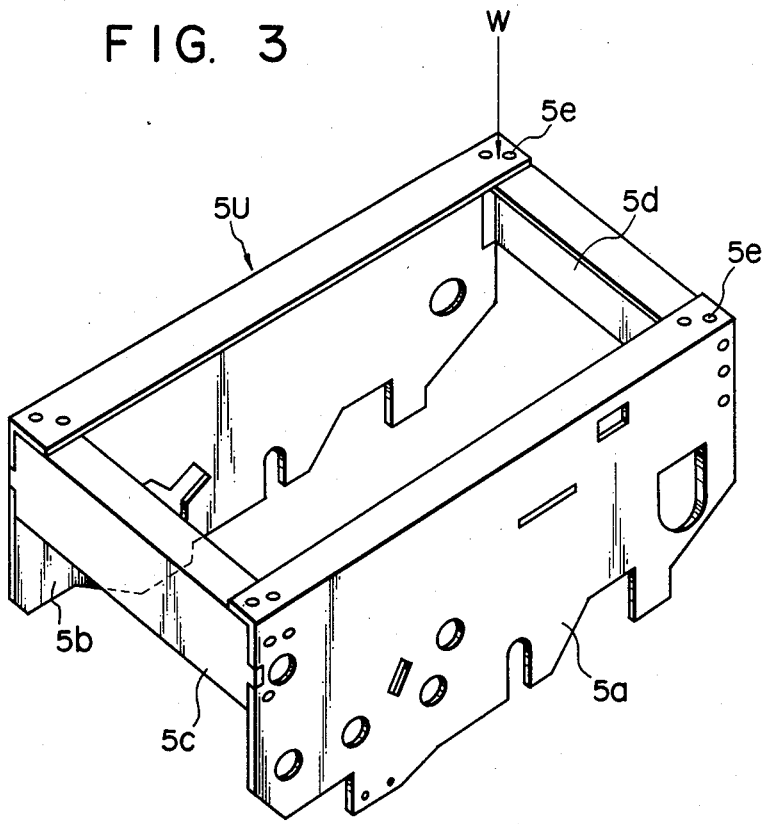
FIG. 3 is a perspective view of an upper frame of the cabinet.

As shown in FIG. 2, the cabinet 5 is divided into upper and lower frames 5U and 5L, which can swing relatively around a supporting point X. When the cabinet 5 is closed, the upper and lower frames 5U and 5L are locked by means of a hook 5H. If only one end of the upper frame 5U is pressed down in closing the cabinet 5, the frame 5U will sometimes be distorted so that the hook 5H will fail to catch an engaged member 5E on the frame 5L. In order to avoid such an awkward situation, the upper frame 5U is constructed as shown in FIG. 3. Namely, the upper frame 5U comprises side plates **5*a* and 5*b* and front and back plates 5*c* and 5*d***.

The upper portions of the plates 5*a* to 5*d* are bent or L-shaped, and the plates 5*a* to 5*d* are fixed to one another at the four top corners of the upper frame 5U by means of screws (or rivets) 5*e*. The upper frame 5U of this construction will never be distorted even if a load W is applied to part of a corner of the upper frame 5U.

Figure 4:
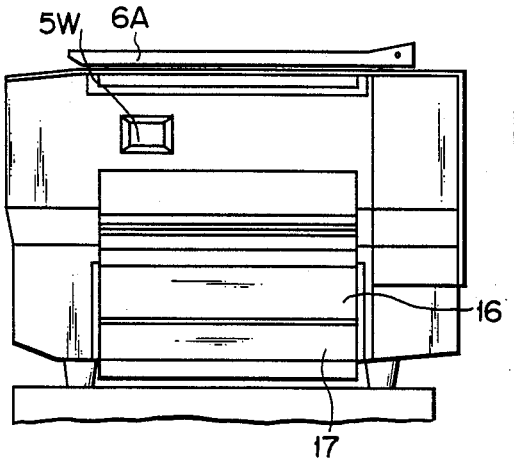
FIG. 4 is a front view of the copying apparatus.
Figure 5A:
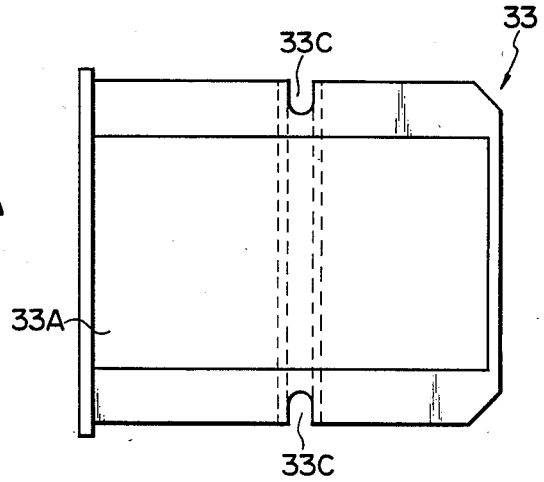
FIGS. 5A and 5B are diagrams showing the two sides of a counter socket.
Figure 5B:
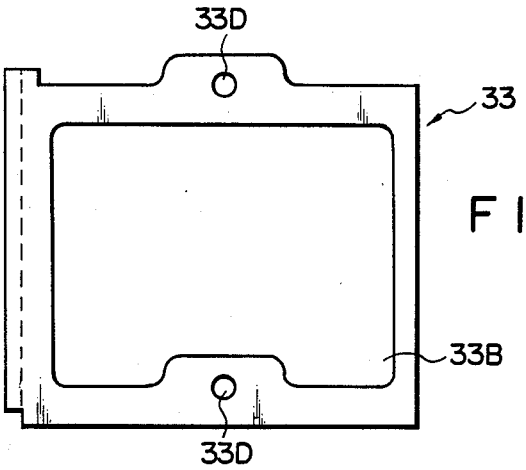

As shown in FIG. 4, a counter mounting window 5W is attached to that side portion of the upper frame 5U on the same side with the paper cassettes 16 and 17. The mounting window 5W is fitted with a box-shaped counter socket 33 as shown in FIGS. 5A and 5B. A blind plate 33A is attached to one side of the counter socket 33, and a window 33B and tapped holes 33D are provided on the other side. The counter socket 33 is attached to the upper frame 5U in a manner such that the blind plate 33A appears in front when a counter is not required to be mounted, and that the mounting window 5W appears when the counter is expected to be mounted. In this case, the counter is inserted into the mounting window 5W, and is attached to the counter socket 33 by means of screws fitted in the tapped holes 33D through mounting holes of the counter. The counter counts and indicates the number of copies produced for copy number management.

Figure 6:
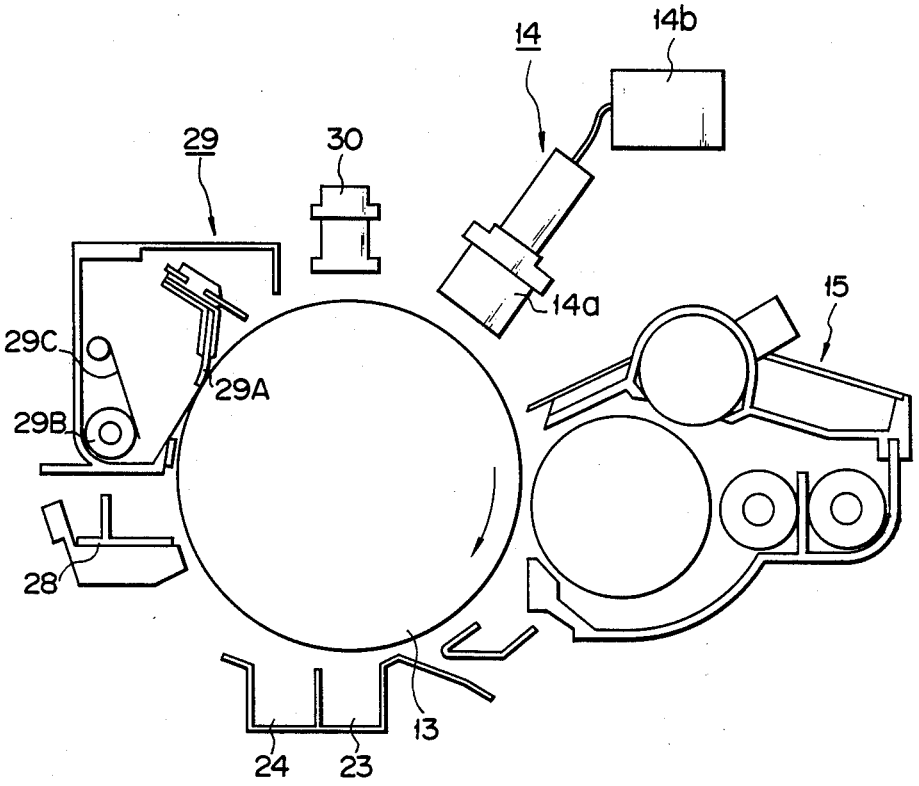
FIG. 6 is a schematic side view of a photoconductive drum section.
Figure 7:
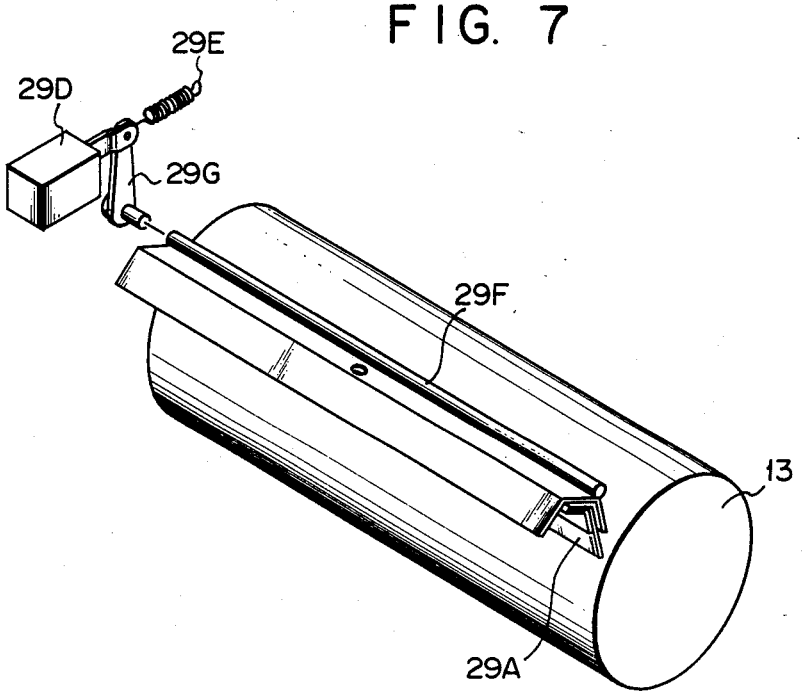
FIG. 7 is a perspective view showing a photoconductive drum and a cleaning unit.

As shown in FIG. 6, the charger unit 14, the developer unit 15, the transfer charger unit 23, the paper peeling charger unit 24, the erasing charger unit 28, the cleaning unit 29, and the erasing exposure unit 30 are successively arranged around the photoconductive drum 13. The cleaning unit 29 is composed of a blade 29A pressed against the photoconductive drum 13, a screw conveyor 29B for conveying toner, and a scratching plate 29*c*. As shown in FIG. 7, the blade 29A is mounted on a swingable shaft 29F, which is coupled to a lever 29G connected to the plunger of an electromagnetic solenoid 29D. The plunger of the solenoid 29D is urged in the direction opposite to the attracting direction of the solenoid 29D by a spring 29E. Thus, the blade 29A is pressed against the photoconductive drum 13 when the solenoid 29 is excited.

Figure 8:
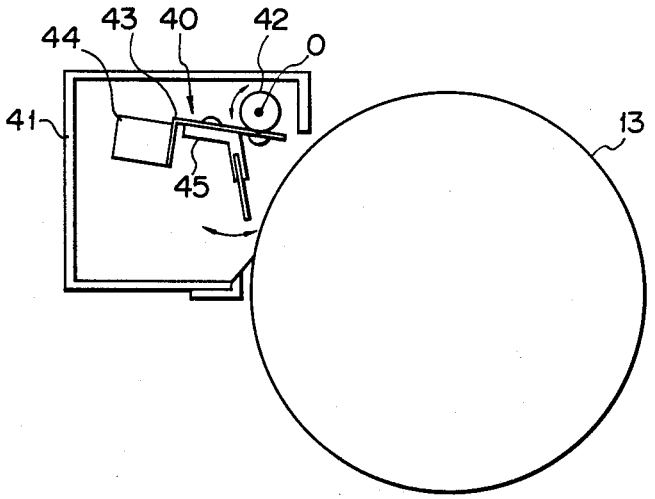
FIG. 8 is a schematic side view of a cleaning unit section.
Figure 9:
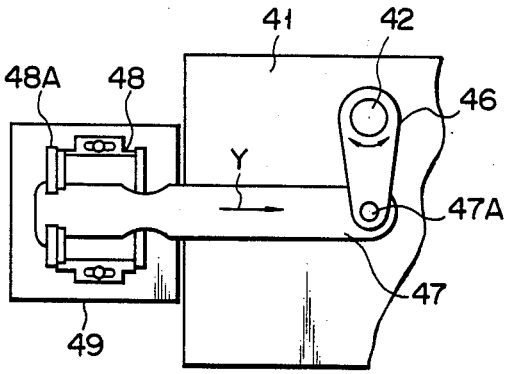
FIG. 9 is a partial plan view of the cleaning unit of FIG. 8.

FIG. 8 shows a modification of the cleaning unit 29. In this modification, a blade shaft 42 is disposed in a case 41. One end of a blade mounting angle bracket 43 is fixed to the blade shaft 42, and a blade 45 is attached to the angle bracket 43. A weight 44 is attached to the other end of the angle bracket 43. As shown in FIG. 9, the extreme end of the blade shaft 42 extends outward from the case 41. An arm 46 is attached to the extreme end of the blade shaft 42, and is coupled to a link 47 by means of a pin 47A. The link 47 is coupled to an armature 48A of a solenoid 48 which is mounted on the angle bracket 49. The armature 48A is urged in the direction opposite to the direction of an arrow Y by a spring (not shown). When the solenoid 48 is excited, the armature 48A is actuated to move the link 47 in the direction of the arrow Y. As the link 47 moves in the direction of the arrow Y, the blade shaft 42 swings counterclockwise to bring the blade 45 into contact with the photoconductive drum 13. At this time, the blade 45 is pressed strongly against the photoconductive drum 13 by the weight 44 attached to the angle bracket 43.

Figure 10:
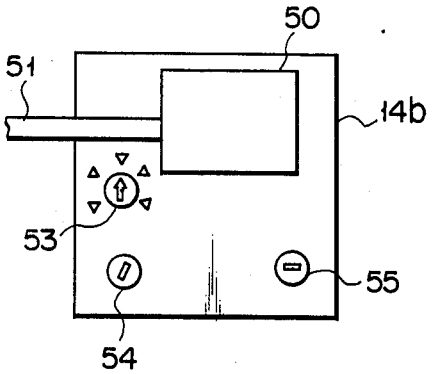
FIG. 10 is a plan view of a charging unit.

FIG. 10 shows the charger unit 14. The charger unit 14 is provided with a high-voltage block 50. A high-voltage output cord 51 of the high-voltage block 50 is connected to a charger 14*a*. A potentiometer 53 serves to regulate the output of the high-voltage block 50 in accordance with the sensitivity of the photoconductive drum 13. Potentiometers 54 and 55 serve to regulate the output of the high-voltage block 50 in accordance with load fluctuation.

Figure 11:
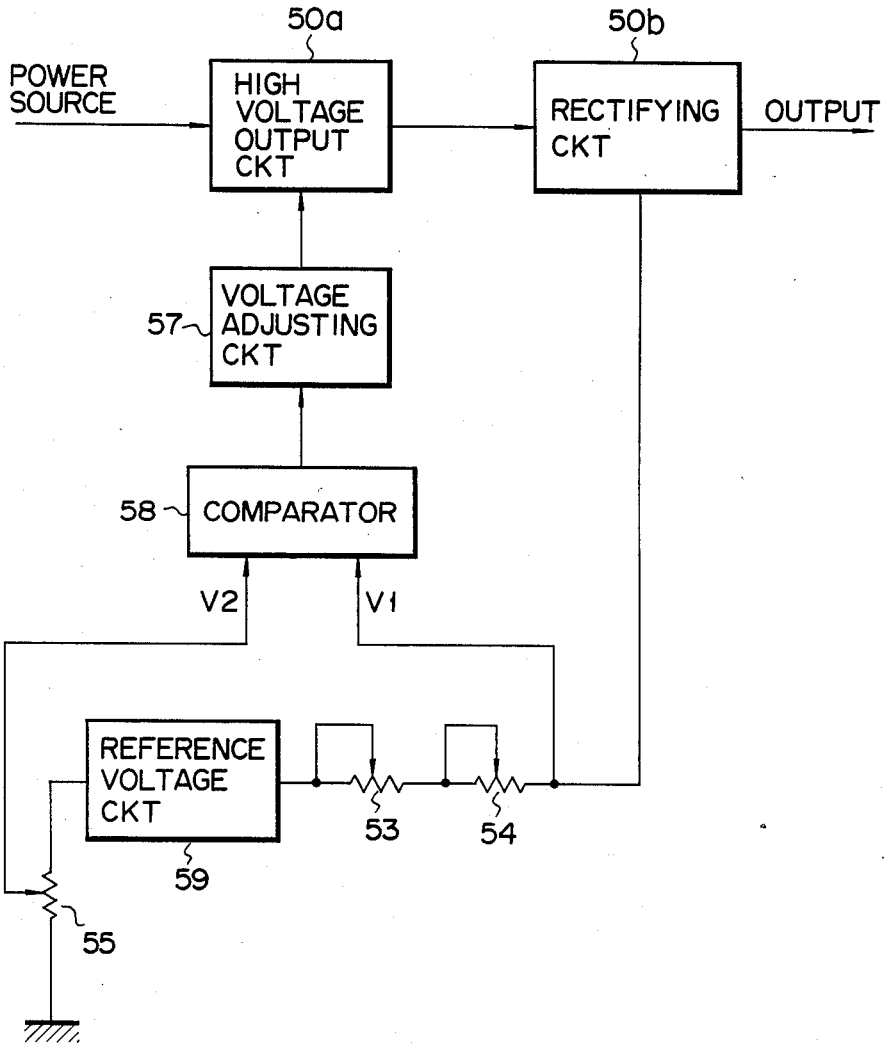
FIG. 11 is a circuit diagram of the charging unit.

FIG. 11 is a block circuit diagram of the charger unit 14. In this block circuit diagram, a power source is connected to a high-voltage output circuit 50*a* of the high-voltage block 50, and the output of the circuit 50*a* is connected to a rectifying circuit 50*b*. A voltage adjusting circuit 57 is connected to the control input terminal of the high-voltage output circuit 50*a*. The voltage adjusting circuit 57 controls the output voltage of the high-voltage output circuit 50*a* in accordance with the output of a comparator 58. The comparator 58 has a first terminal which is connected to a reference voltage circuit 59 through the potentiometers 54 and 53, and a second terminal which is connected to the reference voltage circuit 59 through the potentiometer 55. The potentiometer 54 is also connected to a rectifying circuit 50*b*. In the circuit of FIG. 11, when a current from the reference voltage circuit 59 flows through the potentiometers 53 and 54, a voltage V1 corresponding in level to the current is applied to one input of the comparator 58, where it is compared with a voltage V2 of the potentiometer 55. The comparator 58 produces an output signal based on the difference between the voltages V1 and V2. In response to the output signal of the comparator 58, the voltage adjusting circuit 57 increases or decreases the output voltage of the high-voltage output circuit 50*a*. If the output current is reduced by the load fluctuation so that the voltage V1 rises, the voltage adjusting circuit 57 raises the output voltage of the high-voltage output circuit 50*a* to increase the output current. If the voltage V1 is lowered, on the other hand, the voltage adjusting circuit 57 lowers the output voltage of the high-voltage output circuit 50*a*.

The potentiometer 53 is adjusted in five stages according to the sensitivity of the photoconductive drum 13. Since photoconductive drums vary in sensitivity, the output current of the charging device 14*b* must be adjusted according to the sensitivity of each individual photoconductive drum to obtain a predetermined charging voltage. Therefore, the potentiometer 53 is optionally shifted between a first rank corresponding to the lowest sensitivity and a fifth rank for the highest sensitivity. If a high-sensitivity photoconductive drum of the fifth rank is set in the apparatus, the potentiometer 53 is adjusted to the minimum resistance value. For a low-sensitivity photoconductive drum of the first rank, the potentiometer 53 is adjusted to the maximum resistance value. The potentiometer 53 has marks in positions corresponding to the first to fifth ranks, and the indicator of the potentiometer 53 is set to one of these marks for sensitivity adjustment.

Figure 12A:
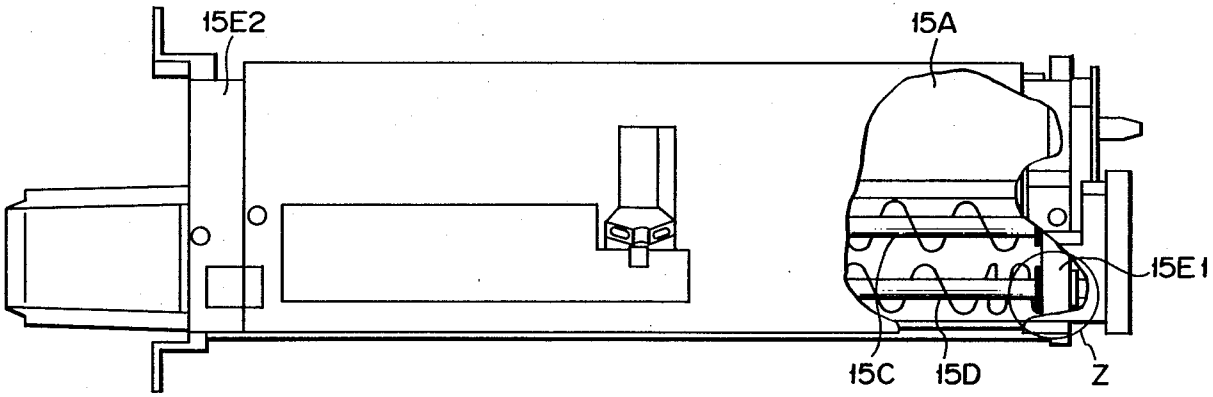
FIG. 12A is a front view of a developer unit.
Figure 12C:
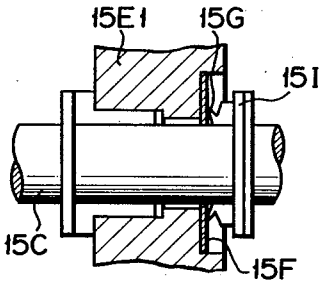
FIG. 12C is an enlarged view of a part enclosed with a circle Z of FIG. 12A.
Figure 12B:
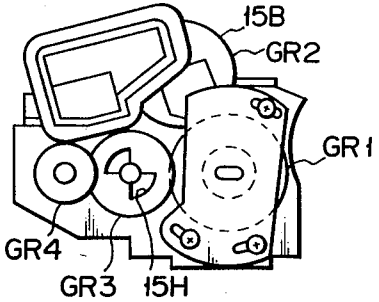
FIG. 12B is a plan view of an auto-toner-probe section of the developer unit of FIG. 12A.

FIG. 12A shows a developer unit 15. In FIG. 12A, two stirring screws 15C and 15D are arranged beside a developer sleeve 15A which includes a magnet roller. As shown in FIG. 12B, an auto-toner-probe 15B lies over the developer sleeve 15A. All these members are rotatably held between bearings 15E1 and 15E2. A first gear GR1 is mounted on the shaft of the developer sleeve 15A, while a second gear GR2 is mounted on the shaft of the auto-toner-probe 15B. Third and fourth gears GR3 and GR4 are attached to the stirring screws 15C and 15D, respectively. The third gear GF3 is formed of a coupling gear having a hollow 15H. Each of the shafts of the stirring screws 15C and 15D is constructed as shown in FIG. 12C. The shaft of the stirring screw 15C is rotatably supported by the bearing 15E1. A masking plate 15F is provided on one side of the bearing 15E1. A seal member 15G having a V-shaped cross section is interposed between the masking plate 15F and a retaining portion 15I. Thus, the masking plate 15F is pressed against one end face of the bearing 15E1 by the seal member 15G. The masking plate 15F is coated with a solid lubricant. A solid lubricant film combining fluorine-contained polymers with various carriers and solvents may be used for the solid lubricant. Since this lubricant film is excellent in low-friction property, corrosion resistance, thermal resistance, electrical insulating property, etc., the friction between the masking plate 15F and the seal member 15G is absorbed by the lubricant film. Thus, there is no possibility of noise being produced or of the drive system being subjected to great load.

Figure 13A:
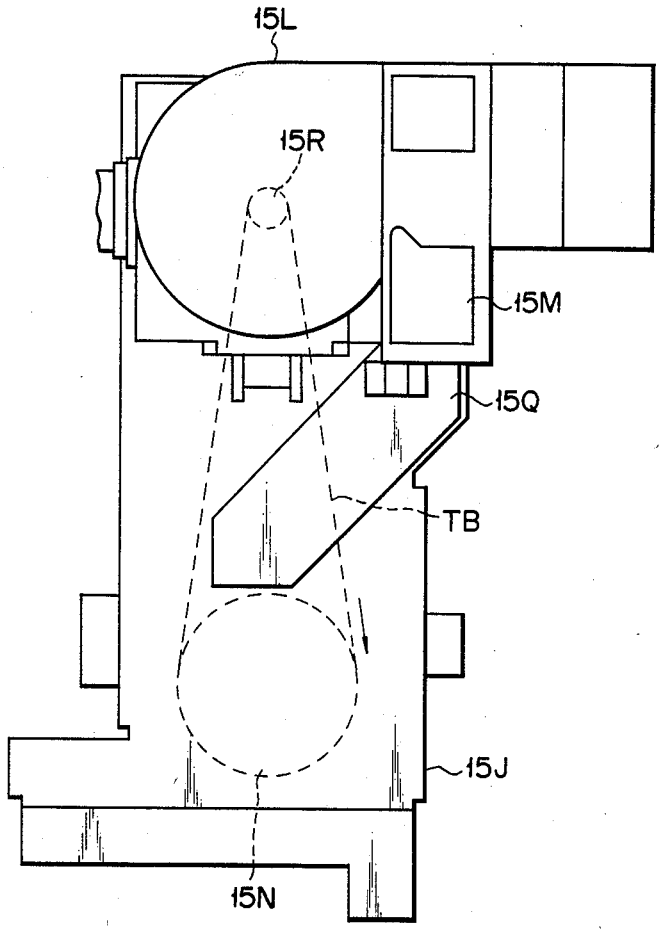
FIG. 13A is a side view of the developer unit.
Figure 13B:
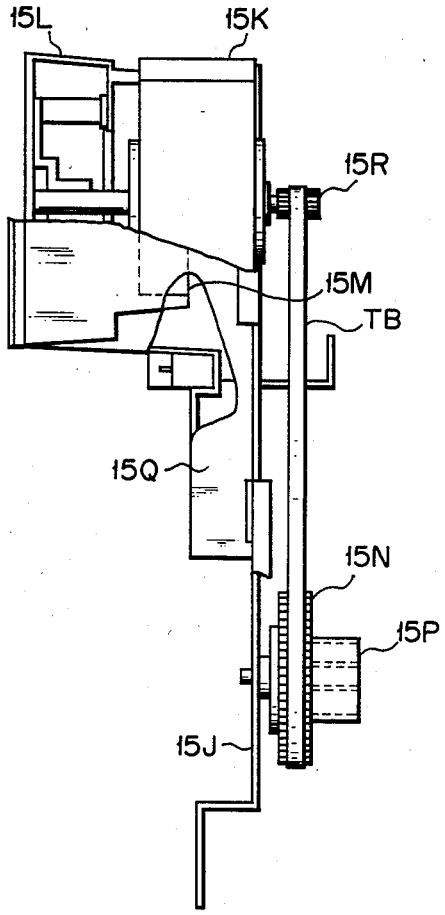
FIG. 13B is a side view of a drive section of the developer unit.

In the developer unit 15 shown in FIGS. 13A and 13B, a pulse motor 15K and a fan 15L coupled to the shaft of the motor 15K, along with a filter 15M and a duct 15Q, are attached to one side of a frame 15J. A first pulley 15R coupled to the motor shaft and a coupling pulley 15N are rotatably mounted on the other side of the frame 15J. A timing belt TB is stretched between the two pulleys 15R and 15N. An engaging projection 15P protrudes from the middle portion of the coupling pulley 15N. The developer unit 15 is driven when the engaging projection 15P engages the engaging hollow 15H of the coupling gear GR3.

Figure 14A:
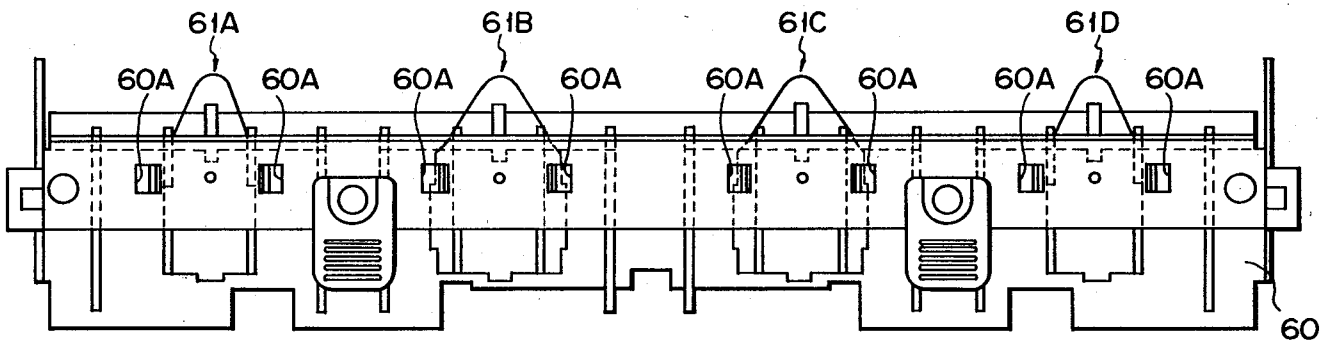
FIG. 14A is a plan view of a guide member of a fusing unit.
Figure 14D:
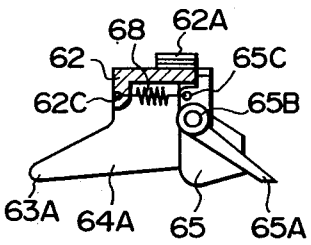
FIG. 14D is a side view showing an assembly of an inner guide and a scraper.
Figure 14C:
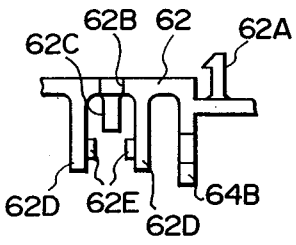
FIG. 14C is a side view of a coupling plate of the guide block of FIG. 14B.
Figure 14B:
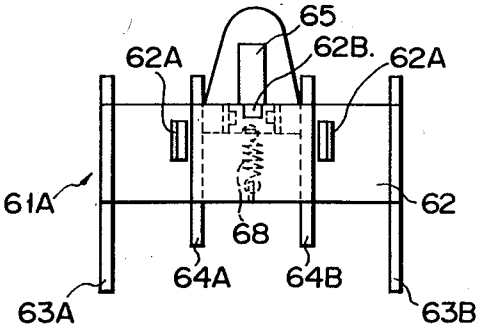
FIG. 14B is a plan view of a guide block of the guide member of FIG. 14A.

FIG. 14A shows a guide member 26C of the fusing unit 26. As shown in FIG. 1, the fusing unit 26 comprises a heating roller 26A, a press roller 26B pressed against the roller 26A, and the guide member 26C. The guide member 26C has a substantially rectangular support frame 60. Four pairs of retaining openings 60A are bored through the support frame 60. Guide blocks 61A to 61D are retained by their corresponding retaining opening pairs 60A. As shown in FIG. 14B, the guide block 61A comprises a pair of outer guides 63A and 63B and a pair of inner guides 64A and 64B coupled together by a coupling plate 62, and a scraper 65 provided between the inner guides 64A and 64B. As shown in FIG. 14C, a pair of hook portions 62A are provided on the top of the coupling plate 62. Scraper holding portions 62D each having an engaging pin 62E hang down between the inner guides 64A and 64B. A projection 62C is formed on the bottom surface of the coupling plate 62. A spring 68 is retained by the projection 62C. The hook portions 62A, the holding portions 62D and the projection 62C, along with the outer guides 63A and 63B and the inner guides 64A and 64B, are formed integrally with the coupling plate 62 by, for example, plastic molding. As shown in FIG. 14D, a scraper 65 is swingably attached to each of the two scraper holding portions 62D. A projection part 65A is integrally attached to the middle portion of the scraper 65, and a rotatable ring 65B is attached to the base of the projection part 65A. The scraper 65 is adapted to become swingable when the rotatable ring 65B is coupled to the engaging pin 62E of its corresponding scraper holding portion 62D. The spring 68 is stretched between the projection or spring engaging portion 62C and a spring engaging portion 65C at the upper end portion of the scraper 65. Thus, the projection part 65A of the scraper 65 is pressed against the heating roller 26A. Constructed in this manner, the guide block 61A is mounted on the holding frame 60 by upwardly inserting the hook portions 62A of the coupling plate 62 into their corresponding pair of retaining openings 60A. Preferably, therefore, the interval between each pair of retaining openings 60A and the width of each opening 60A are set to values such that the retaining openings 60A can easily engage the hook portions 62A of the coupling plate 62.

Figure 15:
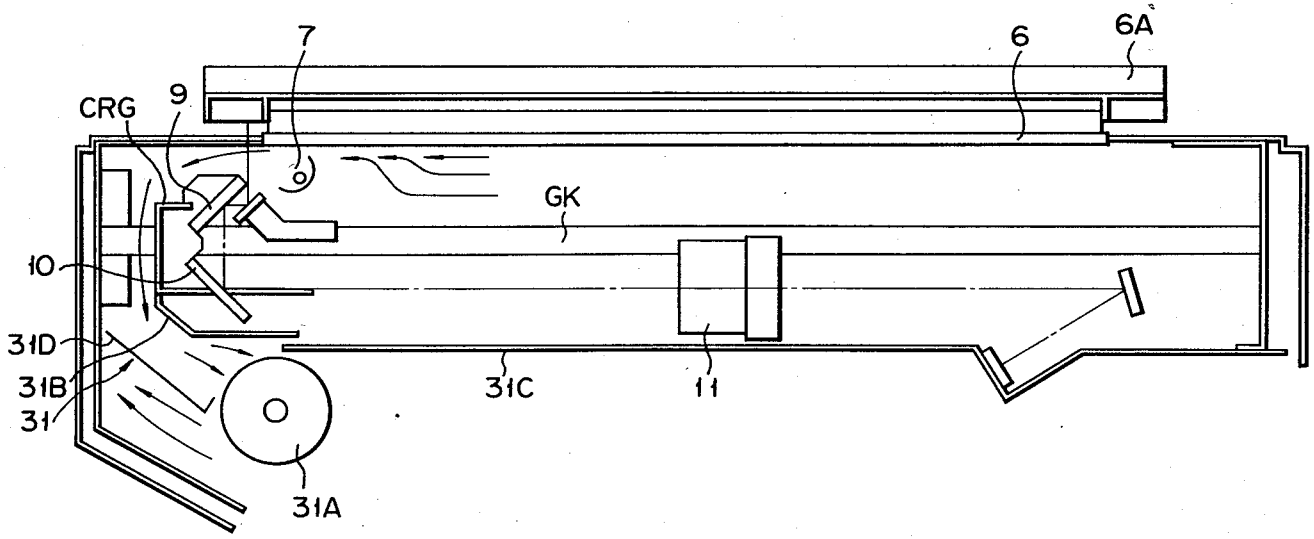
FIG. 15 is a side view showing a cooling unit and an exposure unit.

FIG. 15 shows the cooling unit 31. As mentioned before, the exposure unit is disposed right under the document table 6, and the exposure lamp 7 and the mirrors 9 and 10 of the exposure unit are set on a carriage CRG which can reciprocate along a guide axis GK. The cooling unit 31 composed of the cooling fan 31A and an air duct 31D is disposed under the exposure unit. A bent guide plate 31B extends from the lateral portion to the bottom portion of the carriage CRG. Also, a guide plate 31C is located below the exposure unit. One end of the guide plate 31C is attached to one end of the frame 5U, while the other end thereof is located over the cooling fan 31A. The upper and lower guide plates 31B and 31C overlap each other with a narrow vertical gap between them.

In the cooling unit 31 constructed in this manner, when the cooling fan 31A is rotated, air flows under the document table 6 as indicated by arrows in FIG. 15, and is led into the air duct 31D through the space at the left end of the carriage CRG.

Figure 16:
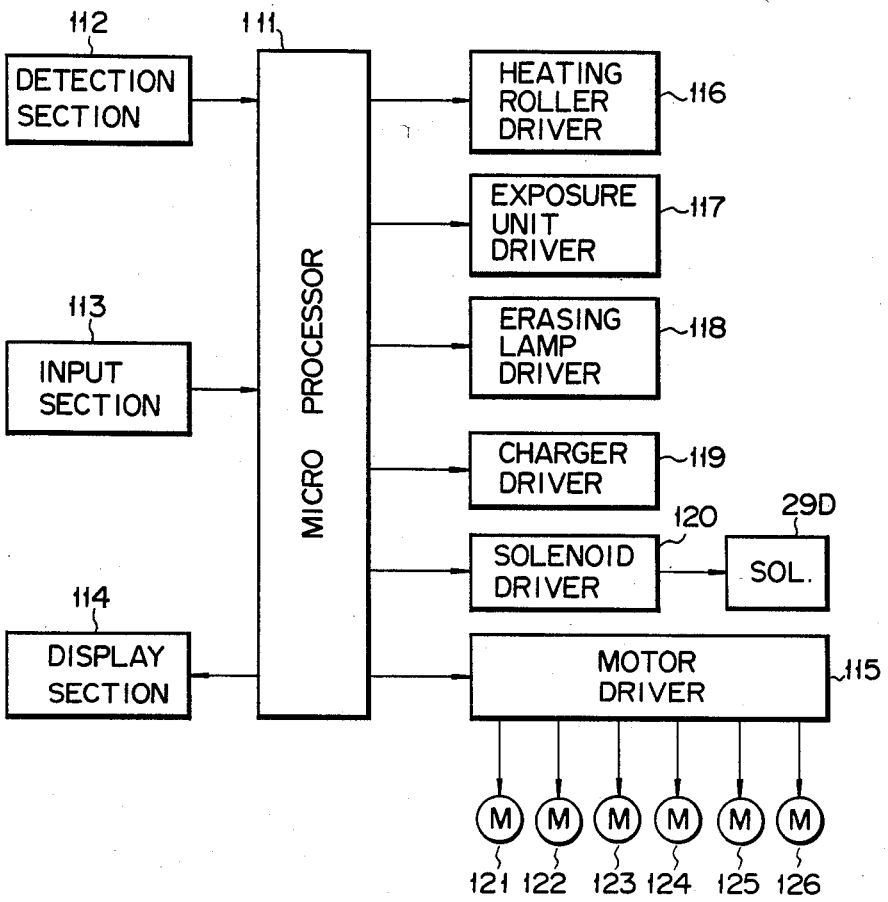
FIG. 16 is a block circuit diagram of the copying apparatus.

Referring now to FIG. 16, a control system of the copying apparatus will be described. In this control system, a microprocessor 111 is connected with a detection section 112 and an input section 113 as inputs, and a motor driver 115, a heating roller driver 116, an exposure lamp driver 117, an erasing lamp driver 118, a charger driver 119, a solenoid driver 120, and a display section 114 as outputs. A plurality of motors 121 to 126 are connected to the motor driver 115. The motor 121 is a stepping motor for driving the moving part of the optical unit including the mirror 9 and other elements. The motor 122 is a stepping motor for rotating, for example, the paper feeding roller 18. The motor 123 is a stepping motor for rotating the resist roller 22. The motor 124 is a stepping motor for rotating the heating roller 26A. The motor 125 is a stepping motor for rotating the photoconductive drum 13. The motor 126 is a motor for driving the developer unit 15.

The detection section 112 includes a paper amount detector, a paper size detector, a paper jam detector, a paper removal miss detector, a door-open detector, a fusing temperature detector, a toner concentration detector, etc. The paper amount detector detects the numbers of paper sheets stored in the upper and lower paper cassettes 16 and 17. The paper jam detector detects paper jamming caused in a paper transport path which extends from a paper feeding unit formed of the paper feeding rollers 18 and 19 to the paper discharge tray 32. The paper removal miss detector, which is located near the photoconductive drum 13, checks to see if the paper is separated from the photoconductive drum 13. The door-open detector detects the "door-open" of the copying apparatus. The fusing temperature detects the temperature of the heating roller 26A.

The solenoid driver 120 is connected with the solenoid 29D for driving the cleaning blade 29A. The blade 29A is pressed against the photoconductive drum 13 when the solenoid 29D is energized.

The operation of the copying apparatus of the aforementioned construction will now be described.

Figure 17:
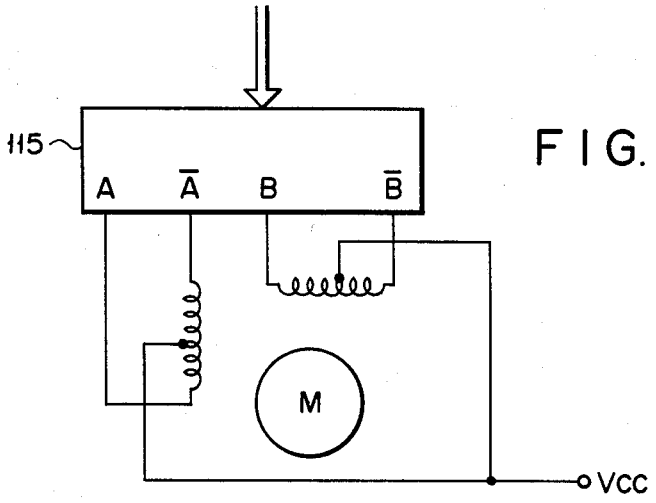
FIG. 17 is a circuit diagram of a stepping motor for driving the photoconductive drum.
Figure 18:
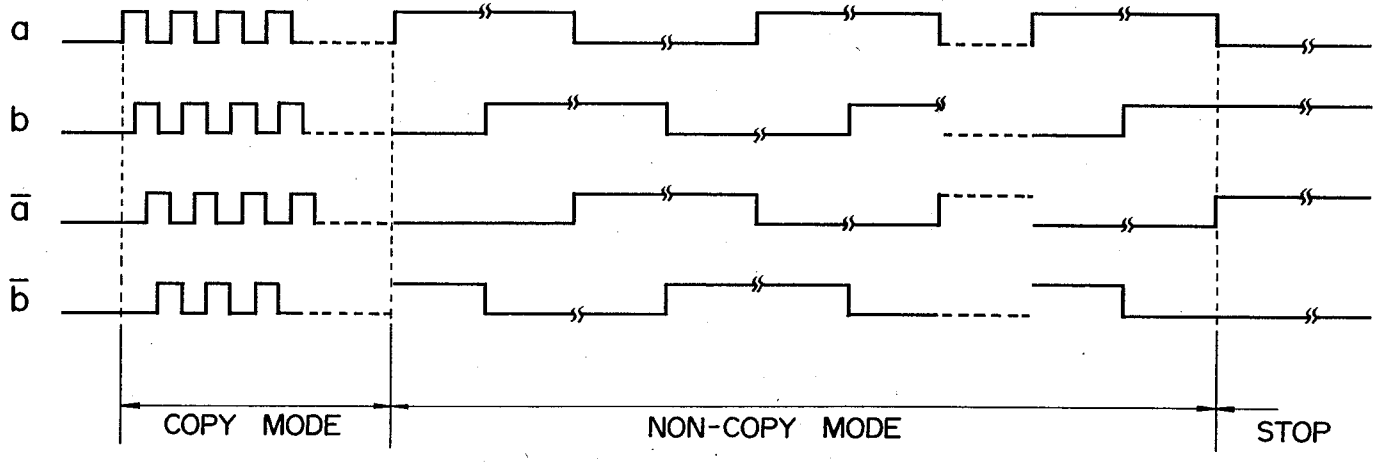
FIG. 18 shows waveforms of drive pulses supplied to the stepping motor of FIG. 17.

When a document is put on the document table 6 and a print switch (not shown) of the input section (keyboard) 113 is activated, the microprocessor 111 causes the solenoid driver 120 to energize the solenoid 29D. When the solenoid 29D is actuated, the cleaning blade 29A is pressed against the photoconductive drum 13. Then, the microprocessor 111 urges the motor drive 115 to rotate the pulse motor 125 for driving drum 13. As shown in FIG. 17, the pulsemotor 125 is a 4-phase pulse motor which is rotated at a speed corresponding to the frequency of drive pulses supplied to phase windings A, B, $\overline{A}$ and $\overline{B}$. The motor speed varies with the mode of operation. Namely, the speed for a copying mode for a copying operation is different from that for a noncopying mode established after completion of the copying operation. In the copying mode, the motor driver 115 supplies the phase windings A, B, $\overline{A}$ and $\overline{B}$ of the pulse motor 125 with drive pulses a, b, $\overline{a}$ and $\overline{b}$, respectively, of 1,500 pps with timing shown in FIG. 18. The phase windings, A, B, $\overline{A}$ and $\overline{B}$ are successively excited by two phases, that is, the phase motor 125 is driven by two-phase excitation. As the pulse motor 125 rotates at 1,500 pps, the photoconductive drum 13 rotates in accordance with this rotational frequency. As the photoconductive drum 13 starts to rotate, the copying operation is started. Namely, the photoconductive drum 13 is charged by the charger unit 13 which is driven by the charger driver 119. The exposure unit is driven by the exposure unit driver 117, and a latent image corresponding to the pattern of the document on the document table 6 is formed on the photoconductive drum 13. The latent image is developed into a toner image by the developer unit 15. At this time, the paper P from the paper cassette 16 is delivered to the resist roller pair 22 by the paper feeding roller 18, and the resist roller pair 22 send the paper P to the space between the photoconductive drum 13 and the transfers charger unit 23. The transfer charger unit 23 transfers the toner image on the photoconductive drum 13 to the paper P. After the transfer, the paper P is peeled from the photoconductive drum 13 by the paper peeling unit 24, and fed to the fusing roller pair 26 by the paper transporting belt 25. The heating roller 26A, which is previously heated to a predetermined temperature by the heating roller driver 116, deposits the toner image on the paper P by fusion. After passing through the fusing roller pair 26, the paper P is discharged as a copy into the tray 32 by the discharging roller pair 27.

After the transfer, the photoconductive drum 13 is discharged by the erasing charging unit 28, and then cleaned by the cleaning unit 29. In other words, the toner remaining on the surface of the photoconductive drum 13 is scraped off by the cleaning blade 29A. Thereafter, the photoconductive drum 13 is exposed by the erasing exposure unit 30, so that fine residual charges are discharged. Thus, a copying cycle is completed. This copying cycle is repeate in accordance with the number of copies required.

After the copying operation is ended, the microprocessor 111 established the non-copying mode in the copying apparatus. At this time, the motor drive 115 reduces the pulse repetition rate of the drive pulse to a value, e.g., 50 pps, which is considerably lower than the value for the copying mode, i.e., 1,500 pps. This situation is indicated by the illustration of the drive pulses in the non-copying mode in FIG. 18. Thus, the pulse motor 125 rotates at a low speed one-thirtieth that for the copying mode. As the pulse motor 125 rotates in this manner, the photoconductive drum 13 is rotated at a low speed. At this time, the cleaning blade 29A is pressed against the photoconductive drum 13. Since the photoconductive drum 13 is rotating at the low speed, however, the cleaning blade 29A does not continuously press the same portion of the photoconductive drum 13. Thus, the photoconductive drum 13 is free from a pitting phenomenon. Moreover, the blade 29A is kept from being separated from the photoconductive drum 13, so that the toner remaining on the surface of the drum 13 will never be sent flying by the blade 29A to stay at the back of the blade 29A.

If the copy switch is activated while the photoconductive drum 13 is rotating at the low speed, the photoconductive drum 13 starts to be rotated at the copying-mode speed by the pulse motor 125 with the cleaning blade 29A in contact therewith, thereby executing the copying cycle. When the low-speed rotation of the photoconductive drum 13, i.e., the non-copying mode, is continued for a predetermined time, e.g., one hour or more, then the microprocessor 111 causes the motor driver 115 to stop the rotation of the pulse motor 126, and the solenoid driver 120 to de-energize the solenoid 29D. When the solenoid 29D is de-energized, the cleaning blade 29A is separated from the photoconductive drum 13.

According to the present invention, as described above, when the copyng operation is completed, the photoconductive drum is rotated for a predetermined time at a speed lower than the rotating speed for the copying mode, with the cleaning blade kept pressed against the drum. After the passage of the predetermined time, the cleaning blade is separated from the photoconductive drum, and the drum is stopped from rotating. Thus, the frequency of the shifting of the cleaning blade relative to the photoconductive drum is reduced, the toner is prevented from flowing to the back of the cleaning blade, and the photoconductive drum is protected against a pitting phenomenon. As a result, the photoconductive drum is improved in cleaning efficiency as well as in life performance. Since the photoconductive drum is stopped after it is rotated at the low speed for the predetermined time, e.g., one hour, wasteful power consumption attributed to prolonged retention of the non-copying mode may be avoided.

Although the photoconductive drum is used for the photoconductive member in the foregoing embodiment, the photoconductive member need not always be a drum.

What is claimed is:

1. An image forming apparatus comprising:

movable photoconductive means;

driving means comprising a stepping motor for moving the photoconductive means;

charging means for charging the photoconductive means;

exposure means for exposing the photoconductive means to form a latent image corresponding to a document pattern on the photoconductive means;

developing means for converting the latent image on the photoconductive means into a developed image; and transfer means for transferring the developed image to paper;

cleaning means having a cleaning blade adapted to be in contact with the photoconductive means for removing a developing medium remaining on the photoconductive means after transfer;

drive signal supply means for supplying selectively signals corresponding to a first speed and a second speed lower than the first speed to the driving means, said drive signal supply means including output means adapted to generate drive pulses of a first pulse repetition rate in the copying mode, and to generate drive pulses of a second pulse repetition rate lower than the first pulse repetition rate in the non-copying mode thereby respectively moving the photoconductive means at the first speed in a copying mode and at the second speed for a predetermined time in a non-copying mode; and means for separating the cleaning blade from the photoconductive means after the passage of the predetermined time.

2. The image forming apparatus according to claim 1, wherein said second pulse repetition rate is one-thirtieth of the first pulse repetition rate.

3. The image forming apparatus according to claim 1, wherein said drive signal supply means supplies the drive pulses to the stepping motor to move the photoconductive means at the second speed for at least one hour.

4. The image forming apparatus according to claim 1, wherein said photoconductive means is a rotatable photoconductive m.

* * * * *

UNITED STATES PATENT AND TRADEMARK OFFICE

CERTIFICATE OF CORRECTION

PATENT NO. : 4,561,762

DATED : December 31, 1985

INVENTOR(S) : Junji WATANABE, Yoshiaki NAWATA

It is certified that error appears in the above-identified patent and that said Letters Patent is hereby corrected as shown below:

ON THE FIRST INFORMATION PAGE:

Change "[73] Assignee: Tokyo Shibaura Denki Kabushiki Kaisha, Tokyo, Japan" to --[73] Assignee: Tokyo Shibaura Denki Kabushiki Kaisha, Kawasaki, Japan--.

Signed and Sealed this

*Twentieth* Day of *May 1986*

[SEAL]

*Attest:*

*Attesting Officer*

DONALD J. QUIGG

*Commissioner of Patents and Trademarks*